US005445196A

United States Patent [19]

Tyree, Jr.

[11] Patent Number: 5,445,196

[45] Date of Patent: Aug. 29, 1995

[54] FILLER FOR SMALL TANKS OR THE LIKE

[76] Inventor: Lewis Tyree, Jr., Mulberry Hill, Liberty Hall Rd., Lexington, Va. 24450

[21] Appl. No.: 272,115

[22] Filed: Jul. 7, 1994

Related U.S. Application Data

[63] Continuation-in-part of Ser. No. 995,774, Dec. 23, 1992, abandoned, which is a continuation-in-part of Ser. No. 813,125, Dec. 23, 1991, Pat. No. 5,195,567, which is a continuation-in-part of Ser. No. 514,295, Apr. 25, 1990, Pat. No. 5,074,343.

[51] Int. Cl.[6] ..... B67C 11/00

[52] U.S. Cl. ..... 141/297; 141/95; 141/98; 141/331; 141/338

[58] Field of Search ..... 141/94, 95, 98, 297–300, 141/331, 333, 336–345; 73/294

[56] References Cited

U.S. PATENT DOCUMENTS

| | | | |
|---|---|---|---|
| 766,616 | 6/1904 | Hagenbach | 141/300 |
| 3,032,080 | 5/1962 | Bures et al. | 141/297 |
| 4,256,154 | 3/1981 | Black | 141/98 |

FOREIGN PATENT DOCUMENTS

| | | | |
|---|---|---|---|
| 0210177 | 9/1940 | Switzerland | 141/300 |
| 0012015 | of 1907 | United Kingdom | 141/300 |
| 0230659 | 3/1925 | United Kingdom | 141/338 |

*Primary Examiner*—J. Casimer Jacyna
*Attorney, Agent, or Firm*—Fitch, Even, Tabin & Flannery

[57] ABSTRACT

Filling units for supplying small tanks or the like with gasoline, kerosene, or other flowable materials which attach to an inlet to such a tank. When the filling unit is in a fill position, a displacer section occupies a substantial volume within the tank and allows the person filling the tank to supply the liquid until the tank will accept no more and the liquid reaches a predetermined level in a funnel portion of the filler. Thereafter, manipulation of the displacer section, as for example by withdrawing a section of the overall unit upward opening a valve or movement within the tank itself, causes all the liquid remaining in the funnel up to such predetermined level to be accommodated within the tank by occupying the volume previously occupied by the displacer section and thereby completing the filling of the tank to a full condition without any spillage. The overall unit may be such that it is intended to be removed from the tank after each filling operation (and preferably stored in an optional, integral storage compartment), or it may be designed to fit permanently within a tank inlet and to be movable downward to a storage orientation, which allows the replacing of the protective screw cap that normally closes the tank.

24 Claims, 8 Drawing Sheets

23
22
22a
22
21
4
4
15
18
19
20

22
22
18
18
23
19

19
22
18

22
23
15
12a
10
21
12
22a
13
14
17
11
12b
16
20
12
12a
10
17
16
27

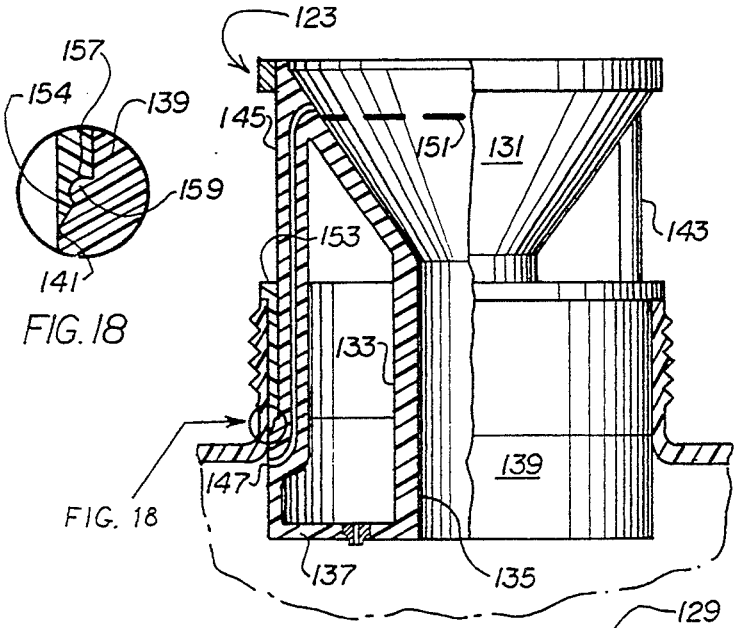
FIG. 18
FIG. 15
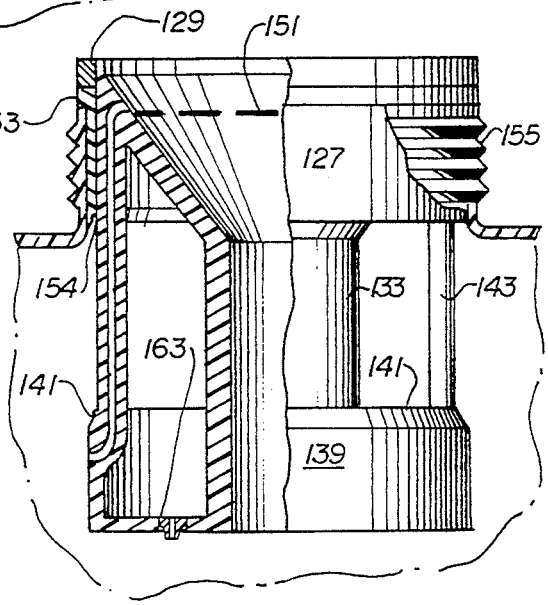
FIG. 17
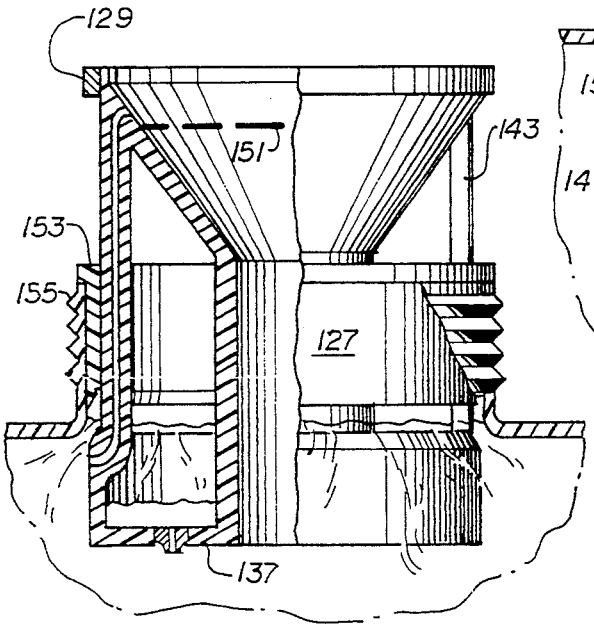
FIG. 16

FILLER FOR SMALL TANKS OR THE LIKE

This application is a continuation-in-part of application Ser. No. 07/995,774, filed Dec. 23, 1992, now abandoned which is a continuation-in-part of application Ser. No. 813,125 filed Dec. 23, 1991, now U.S. Pat. No. 5,195,567, which is a continuation in-part of application Ser. No. 514,295, filed Apr. 25, 1990, now U.S. Pat. No. 5,074,343.

This patent is available for licensing or purchase. The invention relates generally to funnel-like fillers and more particularly to such units designed to mount on or to be part of small tanks, which units contain displacers designed to prevent over-filling of such tanks.

BACKGROUND OF THE INVENTION

The filling of small tanks with liquids has long been a source of inventive ideas, particularly as small gasoline motors and kerosene heaters have proliferated. The environmental damage from spillage during filling has caused the Environmental Protection Agency to include spillage as a significant pollution source. One early variation was developed to fill batteries with acid, which used a float to indicate full condition (U.S. Pat. No. 721,870 to T. A. Edison). Inventions of many other types have resulted as numerous inventors have endeavored to more satisfactorily solve this spillage problem.

Funnels have been designed with almost every type of signal to indicate when the tank is full. Some devices require the small vessel containing the source liquid to be equipped with special spouts. Some spouts have a mechanical trip valve at the end which rests on the mouth of the tank to be filled, with the operator moving the source liquid tank to open or close the trip valve, making such decision by observing the liquid level through the tank opening. A common problem with the valved spouts is visually seeing the liquid level inside the tank so as to know when to stop pouring. Frequently, the first indication of being "filled" is also an overflow.

Some have spouts which contain two passages, one for liquid being poured, the other for the return air, and the dual passage spout is inserted into the to-be-filled tank's opening. When the liquid level therein rises with filling, the return air vent is covered so that flow characteristics change, and the operator then lowers the source tank to where flow isn't possible.

In a variation of the return air control, a dual passage, transparent connection line is connected to the openings of both the tank to be filled and the source tank. The operator observes the return flow through the transparent connection line and controls the flow by raising or lowering the source tank.

Each of these inventions has had some shortcoming, as none has become a universally accepted solution. A general problem with prior funnel devices has been either their complexity (valves, air passages, etc.) or the funnel's resting in the tank opening which obscures the view of the liquid level in the tank or simply the correct size device is not convenient to the operator when filling occurs, or a combination of these causes.

Funnels are desirable so as to provide an enlarged entrance and are particularly desirable when pouring takes place in a hurry.

However, in general, there are two other common problems with funnels: seeing the liquid level as the tank becomes full and what to do with the "lag time" liquid that invariably occurs between seeing that "full" is about to occur and lowering or adjusting the source tank so as to actually cause flow to stop. The "lag time" liquid can represent a substantial amount and is particularly dangerous if it is spilled due to overfilling. In addition, it is desirable to not solidly connect the to-be-filled tank to the source tank, both because of the physical constraints and because of potential leak sources created during filling.

Accordingly, it is desirable to have a funnel to introduce the filling liquid into the mouth of the to-be-filled tank, allowing free-flow from the source tank (or its nozzle). It is also desirable to provide an easily visible early level indication that a "full" condition is about to be reached. It is further desirable that the funnel exits be sized and shaped so that the only time liquid accumulates in its lower portion is when the tank below cannot accept further liquid, i.e., is full. Accordingly, the funnel preferably accepts various flow rates without backup. It is even further desirable to provide a method of accepting a "lag time" apparent overfill without a resultant spill no matter what specific type of spout is used. It is still further desirable that such overfill method control be independent of the orientation or shape of the tank to be filled (i.e., if an air gap is created in the tank by the location of the return air vent in a sealably engaged funnel device, the air gap can easily vary in volume depending on the shape and/or orientation of the tank at the time it is being filled).

Yet another frequently desirable feature is to have the filling unit carried with and as part of the tank to be filled, but in a manner so as to not interfere with nearby functions, and all in a manner that is so simple and foolproof to use that operators welcome its provision. U.S. Pat. No. 4,256,154 discloses a retractable funnel; however, the problem of overfill is not solved by providing a funnel alone.

SUMMARY OF THE INVENTION

This invention provides a filling unit which, in use, has a desirably funnel-shaped portion extending above the tank being filled, and which is appropriately sealed to the tank being filled. It includes a displacer that, during the filling procedure, resides in the container so as to allow an apparent "overfill" of preferably at least a minimum predetermined volume to be subsequently accommodated. The displacer is manipulated so that it no longer displaced liquid in the tank and thus allows all the "overfill" liquid to run into the container.

To function in the desired manner, an appropriate displacer volume is preferably established in the tank with a funnel-shaped portion located above and in sealing engagement with the tank at the time of beginning filling. This displacer volume is utilized either before or simultaneously with either removal of the funnel-shaped portion or return movement of the funnel-shaped portion into the tank. A separate air vent or provision for an appropriate air vent passageway(s) is also preferably incorporated.

One anti-spill filling unit is designed to attach in sealing engagement to a fuel tank or the like in generally the same manner as the fuel tank closure cap, which is first removed to provide entry to the tank. Once such a unit is attached, a displacer section enters the fuel tank as far as permitted. When fuel is thereafter poured into an upper funnel portion of such a filling unit, it freely flows into the fuel tank, and air or vapor is preferably allowed to escape through a vent arrangement which extends above the predetermined level within the funnel portion to which filling desirably extends. Once the tank has become nearly full, fuel builds up in the funnel where it is easily observable, allowing further pouring of fuel to readily be stopped. The displacer section is then moved upward by translation and/or twisting, without breaking the seal to the tank, to allow the fuel within the funnel to drain downward into the empty volume created in the tank when the displacer section is removed upward, i.e., out of the main body portion of the fuel tank. After this particular anti-spill unit is removed from the fuel tank inlet, the fuel tank closure is replaced. In one embodiment, a separate center displacer is constructed to act as a movable reservoir or transfer chamber, and it is used to remove an amount of fuel inadvertently poured so as to occupy the funnel above the predetermined level and return such fuel to its source.

In respect of another aspect of the invention, a different anti-spill filling unit is provided that is particularly designed for use with as a permanent installation in a tank having a wide mouth inlet, for example, an inlet of at least about 2½ inches in diameter. With such a tank construction, it is possible to utilize a filling unit which utilizes an essentially hollow displacer that occupies substantially all of the neck portion of the inlet and can also extend therebelow into what is usually termed the main body portion of the tank. With a unit having this construction, the vertically downward movement of the funnel portion, either by translation or twisting, e.g. screwing, opens the interior volume of the hollow displacer to liquid flow, and the entire amount of overfill liquid in the funnel is accommodated in this manner.

In respect of yet another aspect of the invention, another anti-spill filling unit is provided that is particularly designed for use with as a permanent installation in a tank having a fairly narrow mouth inlet, for example, about 1-¼ inches in diameter. With such a tank construction, it is possible to utilize a filling unit which utilizes an essentially hollow displacer which occupies very little of the neck portion of the inlet, rather principally extending down into the main body portion of the tank. Also utilized is a funnel that is designed to fold and unfold, much like an inverted common umbrella. This allows a funnel of ample proportions to be provided in a narrow inlet. With a unit having this construction, the vertically upward movement of the funnel portion, for instance translation or twisting, e.g. screwing, is preferably also employed to close the top of the interior volume of the hollow displacer, creating an air-lock, i.e. a chamber that will not fill with liquid. Conversely, the return downward movement of the funnel portion, for instance by translation or twisting, e.g. screwing, is similarly employed to open the top of the hollow displacer to atmosphere, breaking the air lock so the displacer becomes full of liquid with the entire amount of overfill liquid in the funnel being accommodated in the tank.

Both of these last-mentioned aspects of the invention provide a funnel conveniently stored inside the tank and include an integral displacer, thus enabling a user to conveniently practice a method of preventing overfilling of a tank.

In respect of still another aspect of the invention, a further anti-spill filling unit is provided which employs an integral funnel-displacer unit that is temporarily mated with the tank at the time filling is desired, which unit carries an appropriate engagement arrangement for sealing to the tubular inlet to the tank. Once filling has been accomplished up to a reference mark in the funnel, simple manipulation of a spring-loaded valve by a finger of the user completes the filling of the tank, after which the unit can be removed and the closure cap replaced.

The use of any of these units allows rapid and complete filling of a container with a flowable fluid to be achieved with minimal risk of spillage.

BRIEF DESCRIPTION OF THE DRAWINGS

FIG. 15 is a view, similar to FIG. 1, of the filling unit incorporating the structure of FIG. 13, installed in a tank inlet and shown in the filling position.

FIG. 16 is a fragmentary view similar to FIG. 15, but shown after the tank has been filled and the funnel portion has been manipulated slightly vertically downward to begin the filling of the hollow displacer portion.

FIG. 17 is a view similar to FIG. 15 showing the filling unit in its completely lowered storage position.

FIG. 18 is an enlarged "bull's-eye" view of a portion of the unit shown in FIG. 15, enlarged in size to illustrate the details of the seal-support.

DETAILED DESCRIPTION OF THE PREFERRED EMBODIMENTS

Illustrated in FIGS. 1 to 5 is a filling unit 10 which is designed to prevent the overfilling of containers having an external attachment means, such as a threaded inlet opening to a small gas tank 16 (shown in dotted outline), to which a cap or the like can be screwed in place to substantially close the tank during normal operating conditions. The filling unit 10 is useful to prevent the overfilling a container of any size and shape with a flowable fluid; however, it is expected to find its primary usefulness to prevent the overfilling of small tanks, such as those commonly found on lawnmowers, snowblowers, outboard motors and the like, with gasoline or the overfilling of space heaters with kerosene.

Figures 1, 2, 3, 4, 5:
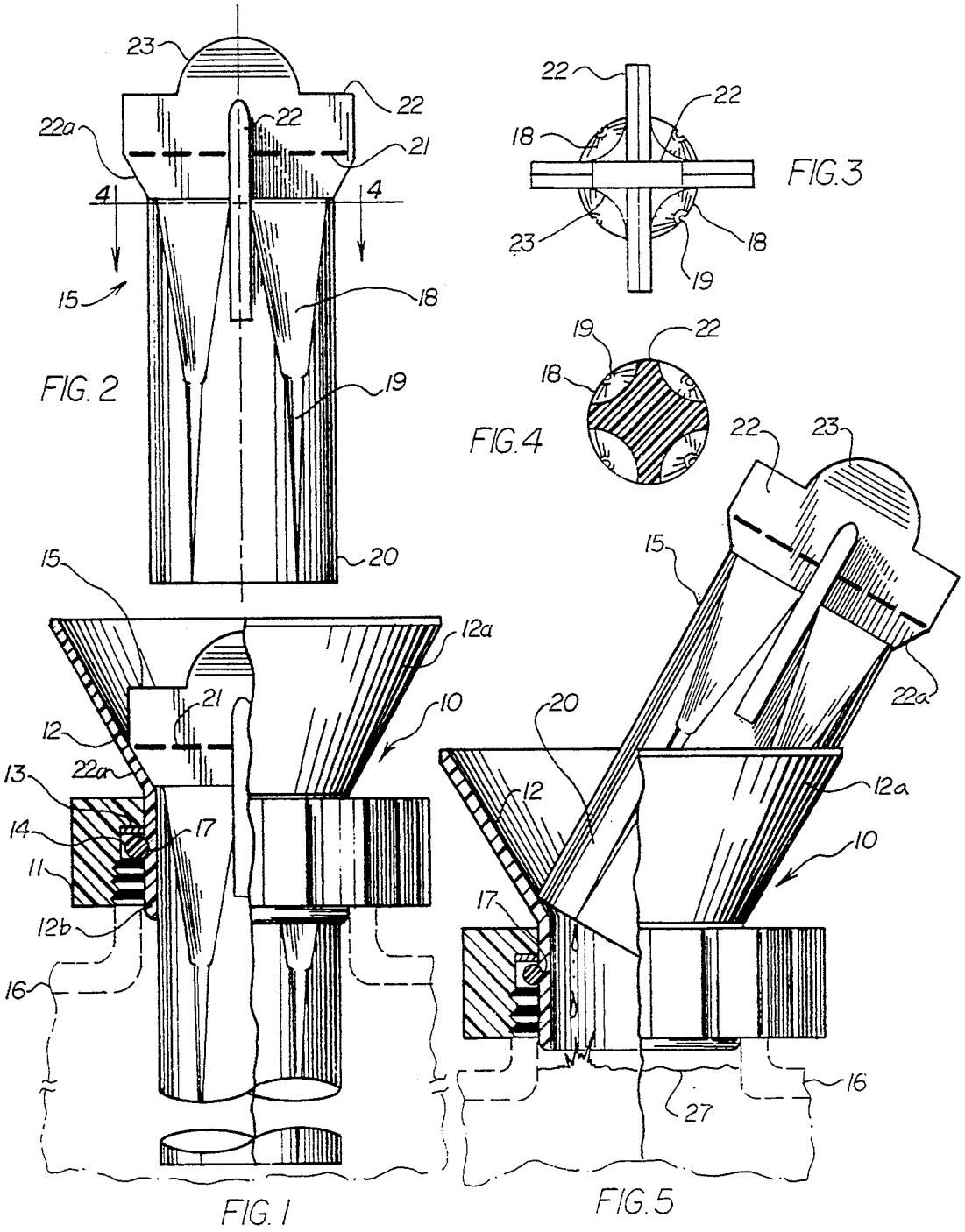
FIG. 1 is an elevational view of a filling unit embodying various features of the invention showing the unit in its lowered or filling position, with the left half showing the unit in partial section.
FIG. 2 is an elevational view of the displacer-flow divider shown in FIG. 1.
FIG. 3 is a top view of the displacer-flow divider shown in FIG. 2.
FIG. 4 is a sectional view of the displacer-flow divider taken generally along the line 4—4 of FIG. 2.
FIG. 5 is an elevational view of the filling unit shown in FIG. 1, showing the unit in its raised or removal position, with the left half showing the holder section of the unit in partial section.

As best seen in FIG. 1, the filling unit 10 includes a funnel unit 12 and a combination divider-displacer unit 15, which units interengage with each other in a manner so as to be relatively moveable, i.e., preferably slidably removable. The funnel unit 12 includes an upper funnel-shaped section 12*a* and a lower neck or throat section 12*b*, and it is preferably made of transparent (as opposed to translucent) material, such as clear polycarbonate or PET (polyethylene terephthalate) both of which are resistant to gasoline-caused deterioration and are transparent. The funnel section 12*a* is preferably frustoconical in shape extending smoothly downward from an upper circular rim of relatively large diameter to a neck or throat section 12*b* of smaller diameter. Although the funnel section is preferably of conical shape, it could have any suitable shape, for example, hemispherical.

An inlet connector or holder 11 is constructed to attach the unit 10 to the inlet of the gas tank 16 (shown dotted). The connector 11 is maintained in assembly with the rest of the funnel unit 12 by an "O" ring seal 14, resiliently located in a groove 17 suitably positioned on the neck or throat portion 12*b* of the funnel unit 12. Alternatively, a collar could be used to hold the "O" ring in proper position. A hard fiber-type washer 13 is located so that, when connector 11 is rotated relative to the neck section 12*b* to thread it onto the inlet opening of gas tank 16, sliding tends to occur between washer 13 and connector 11. Alternatively, the connector 11 could be molded integrally with the funnel unit 12. The combination divider-displacer unit 15 is shown in its lower or filling position in FIG. 1. A reference mark 21 indicates the level above which not to fill and is located on an upper location on unit 15; alternatively, the mark 21 could be located on funnel section 12*a*.

As best seen perhaps in FIGS. 2, 3 and 4, the upper portion of unit 15 acts as a flow-vent divider section, and the lower portion of unit 15 acts as a displacer section 20. A plurality of separate vertical pathways 18 are provided by the unit, i.e., at least two, preferably three, and most preferably four, which communicate from the funnel portion through the throat of filling unit 10. Whereas during filling some pathways will be completely filled with liquid flowing downward into tank 16, at least one will not be so filled and will allow air to simultaneously vent from tank 16. These pathways 18 are open and generously sized until they reach a location below the bottom edge of the neck portion 12*b* of funnel unit 12 so that surface tension of the liquid will not deter the downward flow in such pathways. Although cross sectional areas of such pathways will vary with the size of the unit, each pathway has a minimum cross sectional area of at least about the area of a $\frac{1}{4}$-inch circle and preferably at least about 0.1 square inch. Below the neck 12*b*, the pathways narrow to form drain grooves 19 which allow free exit for liquid still filling the pathways 18, following the completion of fill when the displacer unit 15 is being lifted out of unit 12. The four individual pathways 18 are separated from one another by four radially-extending dividers 22, each of which is tapered at its upper edge to minimize splashing when liquid is being poured into the funnel unit 12. Each of the dividers 22 has an oblique edge surface 22*a* which is shaped to lie in flat, surface-to-surface contact with the upper surface of the funnel section 12*a* and thereby create upper extensions of said pathways 18. One pair of two such aligned dividers 22, which are coplanar, has a central portion that is extended upward to form a ribbed or grooved handle portion 23, which facilitates removal of the divider-displacer unit 15 from the partially filled funnel section 12*a*.

FIG. 3 is a top view looking downward upon the handle 23, the dividers 22, the pathways 18 and the drain holes 19. FIG. 4 is a section view taken at a location below the handle section 23 of unit 15 where the two pairs of aligned dividers 22 have narrowed to the diameter of the displacer section 20, which will be accommodated in the throat of the funnel unit. It illustrates the generally funnel shape of the sidewall, which is a segment of a cone, that each defines pathway 18 and particularly illustrates the relationship of the dividers 22, the pathways 18 and the drains 19.

The filling unit 10 is shown in FIG. 5 after the divider-displacer unit 15 has been lifted to its drain position so that all the liquid previously in the funnel section 12*a* has flowed down into the tank 16, which position is sometimes referred to as the "up" position. One advantage of this filling unit 10 is that the operator can lift the displacer completely out of the funnel 12 and look to see that the liquid level 27 has dropped to a point safely within the tank 16 before unscrewing the connector 11 from the tank inlet and breaking the seal action of O-ring 14 against the upper edge of the tank inlet. Preferably, the proportions of the divider-displacer unit 15 and the funnel unit 12 are such that displacer 15 remains securely in the "up" position, resting with the displacer section 20 lying in line contact along one location on the funnel section 12*a* and with its bottom engaging a diametrically opposite location on the funnel section 12*a*. It can be allowed to remain in this illustrated position during the uncoupling and removal of the filling unit 10 from the tank 16.

Figure 6:
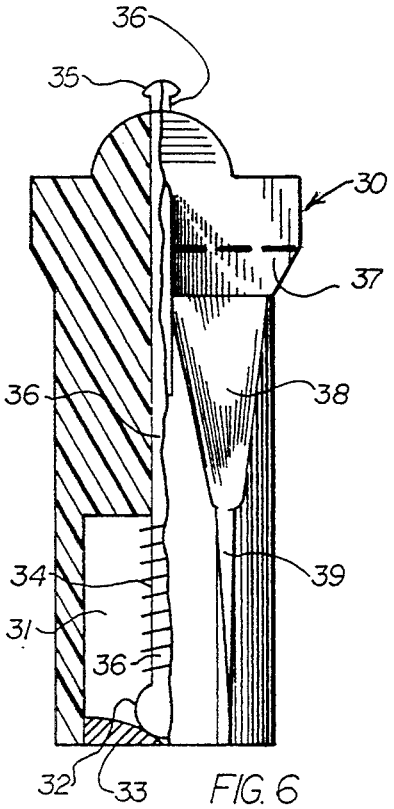
FIG. 6 is an elevational view of an alternative embodiment of a displacer-flow divider which could be substituted for use in the filling unit of FIG. 1 and which incorporates an overfill removal chamber, with the left half in partial section.

Illustrated in FIG. 6 is a special divider-displacer unit 30 which can be substituted for the unit 15 and used with the remainder of the filling unit 10 shown in FIG. 1. The unit 30 includes an optional feature wherein, if excess liquid were inadvertently poured into the filling unit 10 so as to extend substantially above the reference line 37, such excess liquid can be readily and safety removed and returned to its source, usually a portable fuel container. The interior of the lower end of this special divider-displacer unit 30 is hollowed out so as to create a small reservoir or compartment 31, which can be allowed to fill or empty by action of a valve ball 32 against seat 33, which is cemented or otherwise fastened at the bottom of the divider-displacer unit 30 to close the compartment. Buoyancy can be adjusted to compensate for compartment 31 by various methods, e.g. selection of high density materials or molding of metal inserts within portions of the divider-displacer unit 30. A spring 34 maintains a sealing force between ball 32 and seat 33 until it is compressed by the operator lifting a knob 35 that is attached to the top of a rod 36, which in turn is attached at its lower end to the ball 32, thereby compressing spring 34.

If the special divider-displacer 30 is in the fill position and the liquid level is inadvertently caused to extend above the reference line 37, the operator can simply lift the knob 36 to allow liquid to seek its own level and begin to fill the reservoir 31, as air vents upward through clearance provided around the rod 36. Such liquid flow is allowed to continue until the level drops to the reference line 37, at which time the knob 36 is released sealing the reservoir 31 which is now partly filled with liquid. The special divider-displacer unit 30 is withdrawn vertically upward in the same manner as the unit 15, and as the lower displacer section exits from the tank, its volume is filled by liquid flowing downward from the funnel section 12*a* through the pathways 38 and drain holes 39. Following its removal from the filling unit, the special divider-displacer unit 30 is positioned above the upper entry to the portable fuel container, so that the opening through the seat 33 is in line with the opening into the fuel container, and the knob 35 is then again raised upward against the spring, allowing all of the liquid to drain from the reservoir and return to the portable fuel container.

Figure 7:
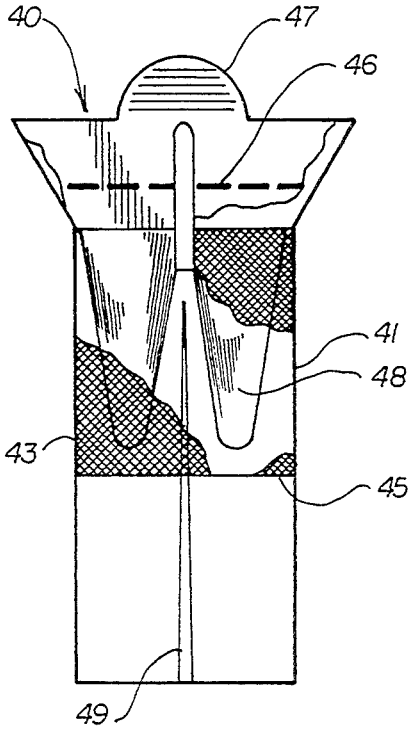
FIG. 7 is an elevational view of another alternative embodiment of a displacer-flow divider which incorporates a fuel filter, with portions broken away to better illustrate certain details.
Figure 8:
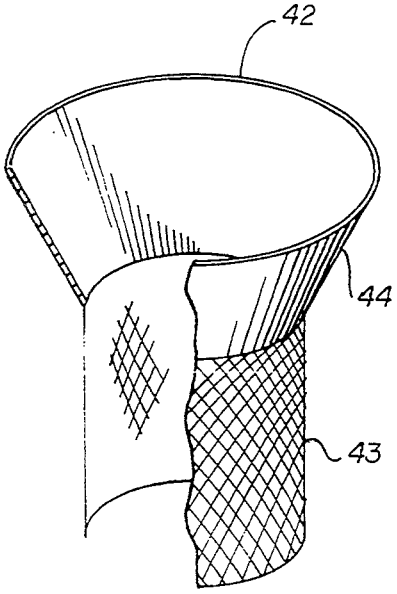
FIG. 8 is a fragmentary perspective view of the filter subassembly of FIG. 7.

Illustrated in FIGS. 7–8 is another alternative embodiment of a divider-displacer-filter combination 40 which can also be substituted for the divider-displacer unit 15 and used with the reminder of the filling unit 10 shown in FIG. 1. It adds a filter function, which can also be incorporated into either the standard divider-displacer unit 15 shown in FIG. 2 or the special divider-displacer 30 of FIG. 6. The combination unit 40 includes a divider-displacer 41 generally similar to unit 15 of FIG. 2 and to unit 30 of FIG. 6, except the drain grooves 19 and 39 of those units have been relocated. Drain grooves 49 are provided in the divider-displacer 41 which are designed to be compatible with the filter subassembly 42 of FIG. 8. Subassembly 42 is comprised of a lower tubular section 43 formed from small-opening filter cloth which is fastened to and depends from a transparent funnel section 44, which is a thin frustoconical section shaped to fit flush against the interior surface of the funnel section 12*a*. This subassembly 42 is slipped over the divider-displacer 41, and it can either be a compression-fit or be suitably fastened thereto at its lower edge 45. All liquid being poured into the tank must pass through the filter cloth 43. When the liquid level reaches the reference mark 46, pouring is stopped, and the unit 40 is then lifted upward by its handle 47. This causes all liquid remaining in the funnel portion 44 to also flow from the lower ends of the pathways 48 through the filter cloth 43. The grooves 49 simply serve to break any possible vacuum that might be created when displacer 41 is lifted upward, either into its "up" position or for visual inspection of the "dropped" liquid level.

Figure 9:
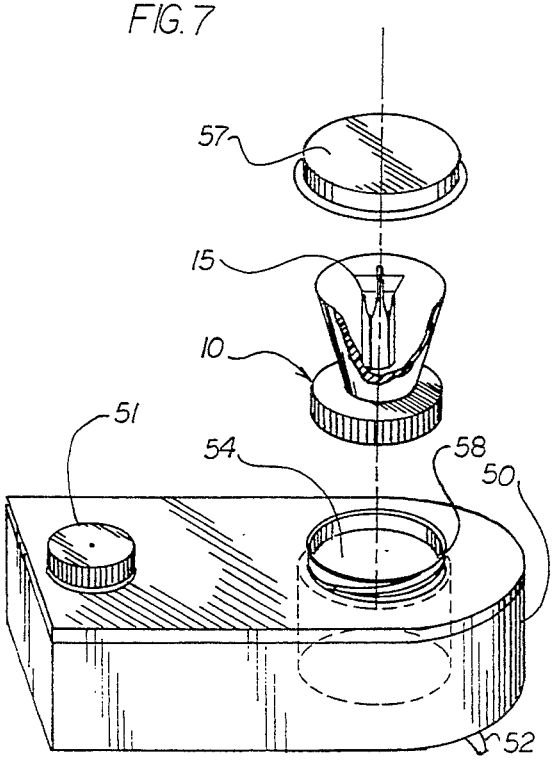
FIG. 9 is a exploded perspective view showing a gasoline tank which incorporates a built-in storage container designed to accommodate the filling unit of FIG. 1, which is shown reduced in size and with portions broken away.

The filling unit 10 of FIG. 1 is shown in FIG. 9 in combination with a fuel tank 50 formed to incorporate a storage compartment 54 designed to receive and store the filling unit 1 0 so that it is always available for use and in a clean condition. While this storage compartment is illustrated as part of the gas tank assembly, which is preferred, it could also be constructed as part of some other component of the overall piece of mechanical equipment being powered, e.g. a cover or shroud of a lawnmower. Typically almost any plastic component lends itself to being molded in a manner to facilitate this additional feature. Illustrated is fuel tank 50, having a screw cap 51 attached to its tubular inlet and having a lower outlet line 52 for supplying fuel to a gasoline engine; such is a typical fuel supply source for a small gasoline engine. Gas tank 50 can be made in a variety of shapes so as to best fit together with the other components; for ease of illustration, it is shown to have a generally rectilinear construction. A storage compartment 54 is provided which is suitably sized and shaped so as to accommodate the filling unit 10, which includes a separate displacer-divider 15. A dust cap 57 snaps or threads onto a mating upstanding rim or surface 58 so as to provide a safe, clean and readily accessible storage area for the properly matched filling unit, which is designed to fasten to the tubular inlet following removal of cap 51. Other variations may also be used to incorporate the filling unit with a fuel tank or the like. For example, the connector might be attached to the tank inlet on a semipermanent basis, and the funnel unit might be extended upward and shaped to accommodate the divider-displacer unit in an orientation oblique or transverse to its filling orientation. An interengaging cap would be provided to securely close the upper end of the funnel unit which has a suitable breathing or pressure-compensating opening, as generally depicted in FIG. 11.

Figure 11:
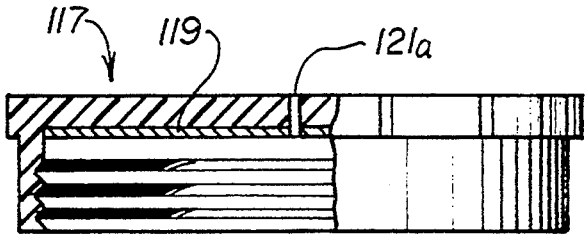
FIG. 11 is a view partially in elevation and partially in section of a storage cap designed to screw onto and close the inlet to the tank in which the filling unit of FIG. 10 is installed.
Figure 10:
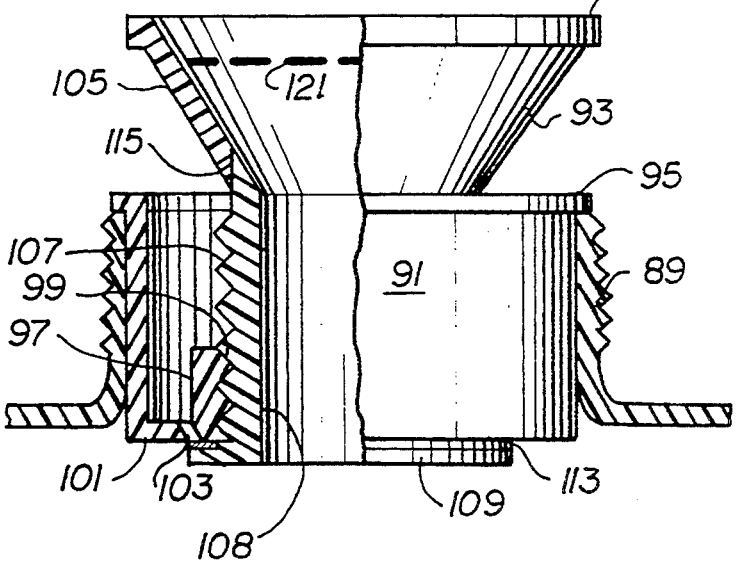
FIG. 10 is a view generally similar to FIG. 1 of an alternative embodiment of a filling unit embodying various features of the invention which is designed to be built into a fuel container and which is shown in its filling orientation.
Figure 12:
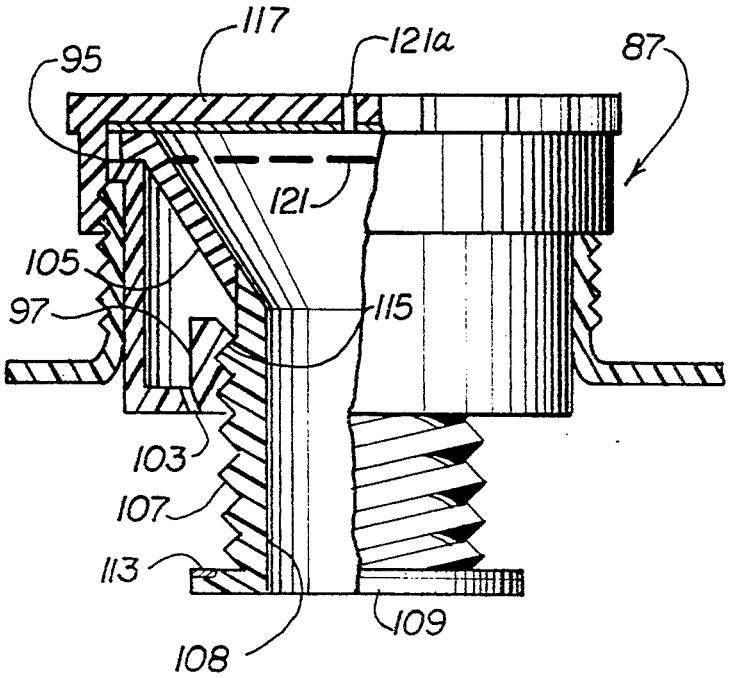
FIG. 12 is a view partially in elevation and partially in section of the filling unit of FIG. 10 shown in the storage orientation with the cap of FIG. 11 installed.

Illustrated in FIGS. 10, 11, and 12 is an alternative embodiment of a filling unit 87 of a design so as to be permanently mounted within the tubular inlet 89 of a tank for supplying fuel to a small engine or a heater or the like. In recent years, tanks for gasoline-powered devices such as lawnmowers, snow blowers, etc. have become to be equipped with inlet openings of a diameter of about 2½ inches, and these larger diameters provide the opportunity for creating a filling unit that can be permanently installed therein. The unit 87 utilizes a hollow displacer which is actuated by manipulating a cooperating element so that it is moved between a vertically elevated filling position and a vertically lowered storage position.

In FIG. 10, the filling unit 87 is illustrated in its raised filling orientation; it includes two relatively movable elements, a holder unit 91 and a generally centrally located funnel unit 93. The holder unit 91 has the shape of an upwardly open cup which has an outer diameter such that it is snugly received within the interior of the tubular inlet 89 of the tank, to which it is permanently suitably cemented. If desired, a thin, flat annular gasket can be provided adjacent the undersurface of a lip 95 at the top of the holder unit 91 so as to assure a tight seal is established between the interior wall of the inlet and the outer surface of the cup portion of the holder unit. An enlarged boss 97 having an internally threaded central aperture 99 is formed in the bottom wall 101 of the holder unit, aligned axially therewithin. As best seen in FIG. 12, one or more holes 103 for liquid passage are provided adjacent the periphery of the central boss 97, in surrounding location to the internally threaded aperture, to initially permit flow of liquid from the underlying region of the tank into the hollow interior of the cup-like holder unit and to subsequently serve as drain holes.

The funnel unit 93 is preferably manufactured in two pieces, which are mated to one another during the assembly of the funnel unit with the holder unit. The funnel unit 93 includes a frustoconical funnel section 105 and a lower stem section 107 having a central always open passageway 108 of constant diameter, which is sufficiently large so that the surface tension of the liquid does not deter the downward flow of liquid therethrough. The stem section 107 has an exterior thread which mates with the interior thread in the boss aperture 99 and has a bottom circular flange 109 of sufficient diameter so as to block flow through the holes 103 in the cup bottom wall that surround the boss. The funnel unit has an upper rim 111 of a diameter substantially the same as the diameter of the lip 95 at the top of the holder unit and has a knurled outside surface to allow it to be grasped and rotated. A flat annular gasket 113 is preferably disposed upon the upper surface of the bottom flange 109 of the stem section 107 to assure a good seal between it and the undersurface of the holder unit when the funnel unit is in the elevated filling position.

In assembly of the filling unit, the annular gasket 113 is installed, and the stem section 107 is then threaded through the axially located aperture 99 in the boss 97. Thereafter, a pair of short cylindrical surfaces 115 at the upper end of the stem section 107 and the lower, smaller diameter end of the funnel section 105 are appropriately joined, e.g. adhesively, to each other to complete the assembly. To install the filling unit in the opening to a gas tank, the standard gas tank cap 117 depicted in FIG. 11 is first removed. The cap preferably has a standard gasket 119 at the undersurface of its top wall to create a liquid seal when it is screwed into place on the threaded tubular inlet 89 of the tank, and it has the usual central vent opening 121*a* to permit slow escape of vapor should there be a pressure buildup within the tank as a result of high temperatures. With the cap 117 removed, the unit 87 is inserted, and the exterior surface of the holder unit 91 is cemented or adhesively attached to the interior surface of the tubular inlet 89, with the low profile lip 95 located in contact with the upper edge of the tubular inlet.

With the holder unit 91 secured in place, the funnel unit 93 is turned counterclockwise, as viewed from above, so as to cause it to extend vertically upward to its highest position, in which the annular gasket 113 will be compressed between the undersurface of the central boss portion of the holder unit and the upper surface of the flange 109 at the bottom of the stem section 107 of the funnel unit. As a result, the entrance from below through the holes 103 leading into the hollow interior of the holder unit is sealed and blocked. In this orientation, the unit 87 is ready for the tank to be filled with liquid.

In the illustrated embodiment, when liquid is poured through the funnel and flows through the always open central passageway of the stem section, air within the tank is allowed to escape directly up the filling passageway through the hollow stem section 107. However, one or more vent passageways could be molded into the stem section, if desired; such passageways would extend vertically upward through the stem portion and join passageways molded in the sidewall of the funnel section 105. Alternatively a multi-pathway flow divider (not shown) could be placed in passageway 108. It assures a portion of passageway 108 is always open and available through which air could escape during filling.

The minimum desired volume to accommodate lag time is calculated based upon the diameter of cylindrical passageway in the stem section 107, and it is found to equal a volume represented by liquid extending upward to reference marks 121 provided on the interior surface of the funnel section. The holder unit 91 is accordingly constructed so as to provide within its interior hollow region, sufficient void volume to accommodate at least this amount of liquid. It has been found that typical lag time can be reduced if funnel 105 is made from transparent material so the rising liquid level is more readily observed. Clear polycarbonates and polyethylene terephthalates are good examples of plastics having high light transmittance properties which are also suitable for use with gasoline and similar fuels.

Accordingly, when filling to about the reference mark 121 has been completed, the user begins to turn the knurled upper rim 111 of the funnel unit clockwise so that it slowly translates downward into the neck of the tank inlet. As soon as the gasket 113 on the bottom flange 109 of the stem unit moves away from the undersurface of the holder, liquid in the tank begins to flow upward through the holes 103 into the hollow region and to simultaneously drain downward to some extent from the interior of the funnel section 105. In addition, the flow of liquid entering the hollow region of the holder (which serves as a displacer in this construction) is accommodating the liquid being displaced as a result of the stem section 107 being screwed downward into the tank itself. The sizing of the hollow section of the holder unit 91 is such that an amount of liquid greater than that displaced by the stem section is accommodated within the generally annular hollow region, and thus the liquid level within the funnel section 105 drops below the reference mark 121. When the funnel unit has been threaded to its lowered position so that the undersurface of the rim on the funnel unit engages the upper edge of the holder unit, the filling unit 87 has reached its storage orientation (as shown in FIG. 12), and the cap 117 for the tank is threaded onto the tubular inlet 89 above the stored filling unit 87. While the preferred embodiment utilizes a threaded stem section 107 and a flat gasket 113, an alternate embodiment would be to construct the stem so that it is slidable upward and downward and the sealing gasket is angled so that it both seals and engages in the upward or filling position, generally like the embodiment next described herein. As another alternate arrangement, the central passageway might be sized and shaped and the displacer located so that a float post of a standard contents-reading cap, such as those available from Kelch Corp. of Mequon, Wis., can fit thereinto and be used to close the tank.

Figures 13, 14:
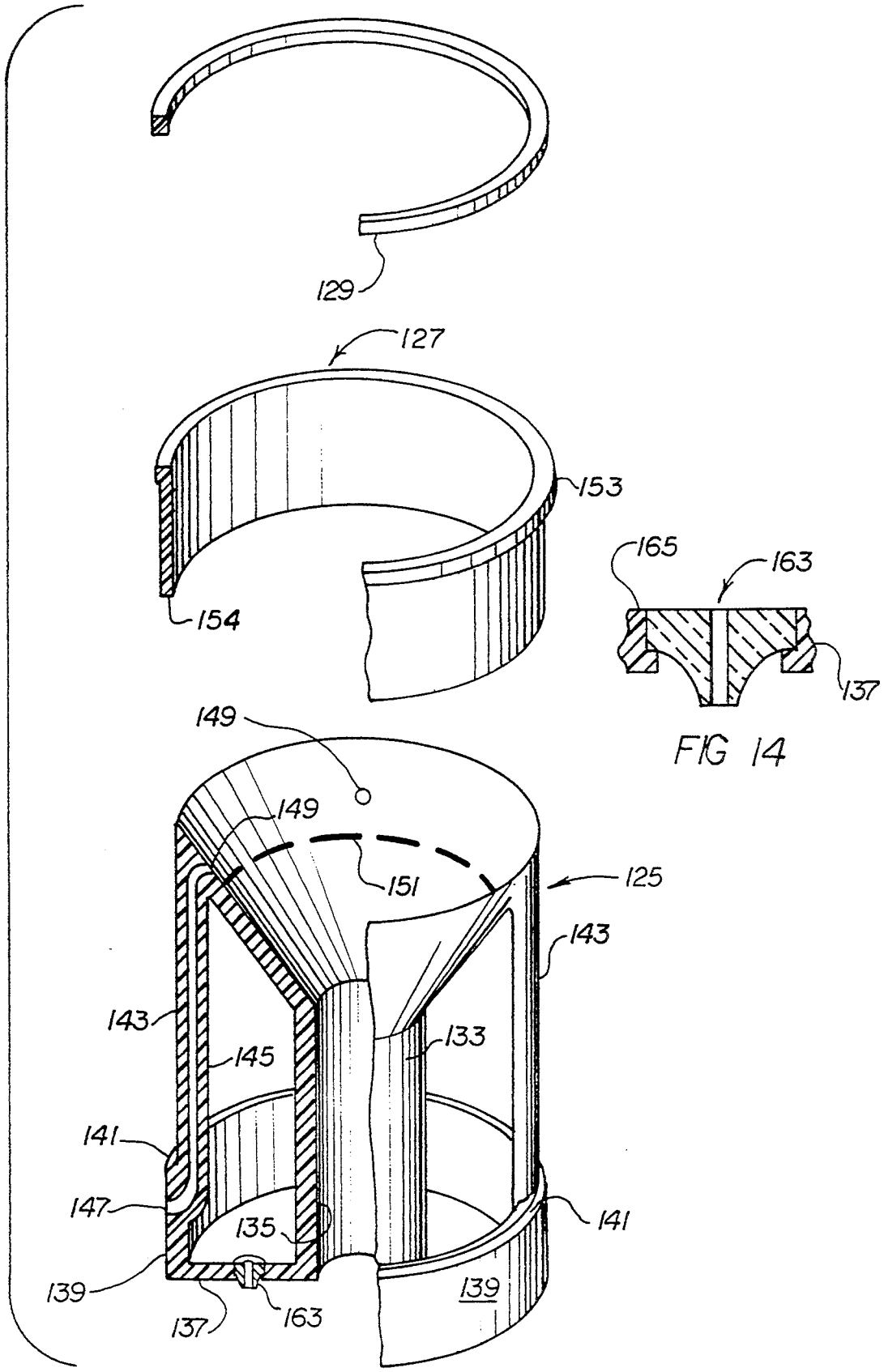
FIG. 13 is an exploded perspective view of portions of still another alternative embodiment of a filling unit with portions broken away and shown in section.
FIG. 14 is a fragmentary sectional view, enlarged in size, showing a portion of the bottom element of FIG. 13.
Figure 20:
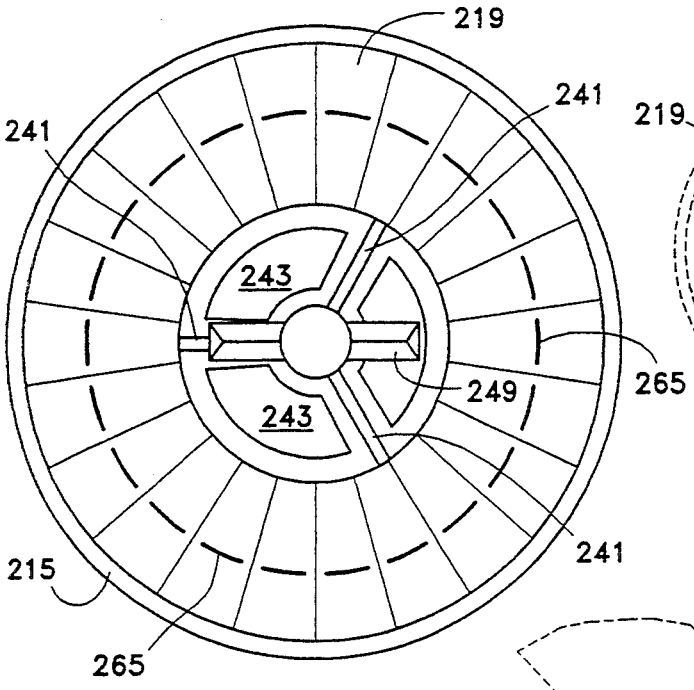
FIG. 20 is a top view of the filling unit of FIG. 19.

Illustrated in FIGS. 13–18 is yet another filling unit 123 which somewhat resembles the filling unit just described with respect to FIGS. 10 to 12 in that it also utilizes a hollow displacer section, and in that the unit 123 also has a vertically elevated filling orientation and a lowered storage orientation. As best seen in FIG. 13, the unit 123 is essentially made of three separate molded pieces, i.e., a funnel unit 125, a surrounding generally tubular holder unit 127 and an upper retaining ring 129.

The funnel unit 125 includes an upper frustoconical funnel section 131 from which depends a tubular lower section 133 having an always open central passageway 135 with constant throat diameter, which section extends to the bottom of the unit. The diameter is of such size that surface tension of the liquid does not deter the downward flow of liquid therethrough. An annular bottom wall 137 extends radially outward from the bottom of the tubular section and joins an outstanding annular sidewall 139 which has an oblique upper edge 141 that functions as a sealing surface as described in detail hereinafter. Four posts 143, spaced regularly at 90° intervals about the circumference, extend from the interior surface of the annular sidewall 139 to the undersurface of the frustoconical funnel section 131, meeting the funnel section along its outer edge. These posts 143 are formed to have longitudinally extending central passageways 145 which serve as vent passageways and which lead from four angularly oriented entrances 147 formed in the outer surface of the upstanding sidewall to four exit holes 149 which appear in the interior surface of the funnel section at a location above reference marks 151 which mark the predetermined level of fill. As an alternative arrangement, instead of including the vent passageways 145, a multi-pathway flow divider (not shown) could be placed in passageway 135; such would tend to keep a portion of passageway 135 always open and available for escape of air during filling. However, the posts 143 not only provide elevated vent passageways, but they also serve as frictional bearing surfaces which rub against the interior surface of the tubular holder 127 as explained hereinafter.

The holder 127 is formed with a tubular sidewall having an outwardly extending lip 153 at its upper end and an oblique lower wall 154, which as explained hereinafter is designed to seal with the upper edge 141 of the upstanding sidewall 139 of the funnel unit. The dimensions of the holder are such that it is snugly received within the interior of the tank inlet and is adhesively joined thereto with the upper lip 153 resting on the upper edge of the inlet 155. The inner dimension of the holder is such that it is essentially the same as the inner diameter of the upstanding sidewall portion 139 of the funnel unit, and it preferably frictionally bears against the outer surfaces of all four of the upstanding posts 143. In the assembly of the unit, the holder 127 is lowered over the funnel section 131 and slides downward along the outer surfaces of the four posts 143. With the holder 127 thus mated to the funnel unit 125, the upper retainer ring section 129 is affixed in place using a suitable adhesive (or by thermal bonding) along the mating surfaces at the top of the exterior of the funnel section 131.

To install the completely assembled unit in a gasoline tank or the like, the tank cap is removed, and the bottom end of the funnel unit 125 is pushed through the inlet opening. Preferably, adhesive or cement is applied to the exterior surface of the holder 127 before it is pushed downward snugly into the interior of the tubular inlet so that the upper lip 153 seats atop the upper edge of the tubular inlet.

After the adhesive or cement has hardened and one is ready to fill the tank, the user grasps the retainer ring 129 and pulls the funnel unit 125 upward. The unit slides smoothly upward with frictional force between the four posts 143 and the interior surface of the holder 127 maintaining the filler unit in alignment. The funnel unit is moved vertically upward until the oblique surfaces 141, 154 engage each other and create a seal to liquid flow therepast. To assure that a very good seal is created and to also assure that the funnel unit 125 will remain in the raised position, a tongue-and-groove arrangement is preferably molded into the two mating oblique surfaces, as best seen in FIG. 18. The oblique lower surface 154 of the holder is preferably formed with an annular groove 157 that continues for 360° about the surface. Similarly, the upper oblique edge surface 141 of the upstanding sidewall portion 139 of the funnel unit, which has the same angular orientation, is formed with a mating tongue or bead 159 which is proportioned to snap into the groove 157 when the funnel unit 125 reaches its elevated filling position; thus, the mating of the tongue-and-groove assures not only that there is a 360° seal about the hollow interior of the lower portion of the funnel unit (which serves as a displacer section in this filling unit 123) but also assures that the unit will remain in its uppermost filling orientation until the user applies pressure to break the seal between the tongue-and-groove arrangement and cause it to translate downward.

Accordingly, with the filling unit 123 in the orientation shown in FIG. 15, the tank is filled with liquid, the level of which is allowed to extend upward to the reference line 151 within the funnel section. Again lag time could be minimized if funnel section 131 is formed from transparent material so the rising liquid level can be more readily observed. After the user sets down the tank of fuel, he applies pressure to break the seal at the mating surfaces and to slightly depress the funnel unit 125. As depicted in FIG. 16, as soon as the funnel unit 125 is slightly lowered, liquid from the tank pours over the upper edge of the upstanding sidewall 139 and begins to fill the hollow interior region that is provided in the annulus between the upstanding sidewall and the central tubular section. The funnel unit 125 is ultimately caused to slide vertically downward until the retainer ring 129 seats atop the upper surface of the lip 153 of the holder, as illustrated in FIG. 17. In this lowered orientation, some of the liquid from within the funnel section 131 has become accommodated within the hollow interior region of the displacer section, and the filler unit is now in its storage configuration, which permits the user to reinstall the gas tank cap on the outer threaded surface of the upstanding tank inlet 155.

As the gasoline or other fuel within the tank is slowly used to power the engine or the like, the liquid level drops below the bottom wall 137 of the filler unit, and the fuel which earlier overflowed the upstanding sidewall 139 drains from the hollow region through a drain valve 163 provided in an aperture 165, best seen in FIGS. 13 and 14, in the bottom wall. A soft rubber drain valve 163, of a type well known in the art, is adhesively or otherwise suitably affixed in the aperture 165 in the bottom wall 137. It serves as a fairly efficient check valve which allows only downward flow through the aperture. Because of the soft rubber design, the valve 163 tends to distend along its thin lower end upon the application of back-pressure and effectively thwarts any significant flow of liquid upward therethrough, while permitting liquid in the region thereabove to slowly drain downward by gravity through the narrow central opening as the contents within the tank are used.

Illustrated in FIGS. 19 through 26 is a further embodiment of a filling unit 205 embodying various features of the invention which is also designed to be permanently mounted within a tubular inlet 211 of a tank (shown in broken lines) for supplying fuel to a small engine or the like, where the inlet is fairly standard in size and has a smaller diameter than either of the inlets 89 or 155. For example, the inlet 211 may have an interior diameter of about 1-¼ inches. The filling unit 205 employs a generally tubular holder unit 213 that is secured to the interior sidewall of the inlet 211. The holder unit 213 is preferably proportioned to fit snugly within the interior of the tubular inlet to which it is suitably permanently cemented. If desired, a thin gasket could be provided between the two to assure there is a fluid seal for 360°. The holder 213 receives and interconnects with an integral funnel-displacer unit 215 having a cylindrical surface portion of slightly smaller outer diameter so that it is received coaxially therewithin. The unit 215 includes a main body portion 217, a foldable funnel portion 219 and a lower displacer portion 221 which defines a downwardly open hollow chamber 223. As best seen perhaps in FIGS. 19, 23 and 24, it has a generally cylindrical outer wall 225 with the general exception of 3 curved flow passageways 227 which provide an always open passageway from the upper funnel portion of the unit to the interior of the tank in which the filling unit is installed. As best seen perhaps in FIGS. 19 and 24, formed within the cylindrical surface portion 225 of the displacer section are 3 guide slots 229, each of which has a central main diagonal section 231*a* that terminates in an upper horizontal section 231*b* and a lower horizontal section 231*c*. The interconnection between the holder unit 213 and the funnel displacer unit 215 is provided by 3 inwardly protruding lugs 233 which are received in the guide slots 229. The 3 lugs are equidistantly spaced at about 120° relative to one another about the bottom edge of the holder unit 213 and protrude inwardly therefrom where they are received in the guide slots 229 and guide the relative upward and downward movement of the funnel-displacer unit, as explained hereinafter.

Figure 21:
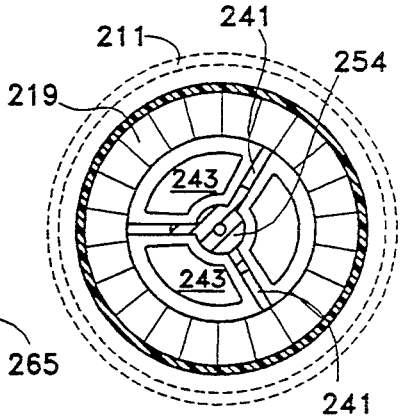
FIGS. 21–23 are sectional views of the filling unit of FIG. 19 taken respectively along the lines 21–21, 22–22 and 23–23.
Figure 22:
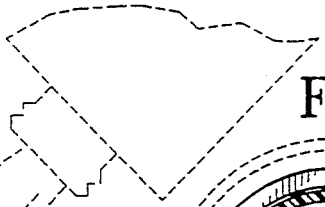
Figure 19:
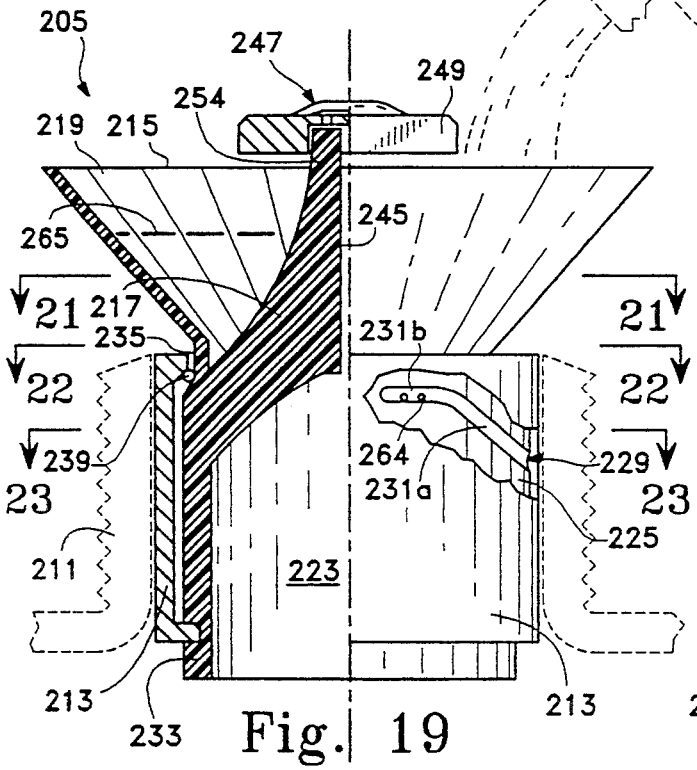
FIG. 19 is an elevational view of a further embodiment of a filling unit designed to be built into a fuel container incorporating various features of the invention, which is shown in filling orientation with its left half in partial section and a portion of the right half broken away.
Figure 23:
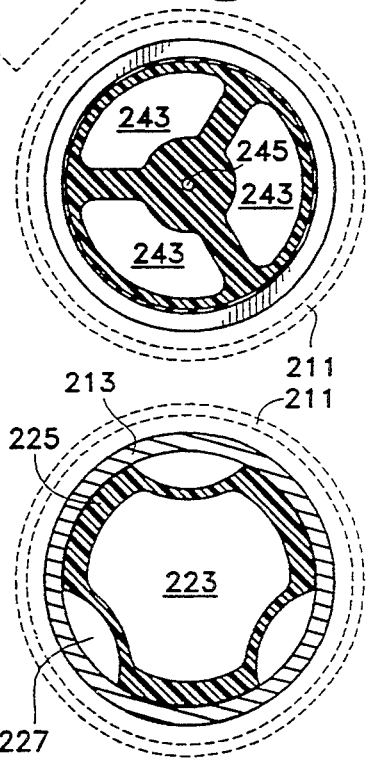

The main body 217 includes an upwardly extending short tubular support 235 which serves as the base of the foldable funnel 219 and has an outer diameter just less than the inner diameter of an annular boss 237 which is formed at the top of the holder unit 213. A groove near the base of the short cylindrical support 235 receives an O-ring 239 which creates a 360° seal between the interior of the holder unit 213 and the main body 217 of the funnel-displacer unit when the unit is in its raised or filling orientation, as shown in FIG. 19. Thus, in the raised position, the only communication from the interior of the tank is through the flow passageways 227 and the funnel 219. The main body 217 has a central, somewhat cylindrical portion from which 3 evenly spaced ribs 241 extend, as best seen in FIG. 21. The ribs 241 serve as flow dividers, and pairs of these ribs respectively flank 3 segmental openings 243 that lead smoothly downward into the 3 curved flow passageways 227 formed in the outer surface of the displacer portion 221 of the unit, thus providing pathways for liquid from the funnel 219 through the segmental openings 243 and then through the flow passageways 227 into the tank. The size of the segmental openings 243 and the curved passageways 227 is such that the surface tension of the liquid does not deter downward flow therethrough.

Figure 26:
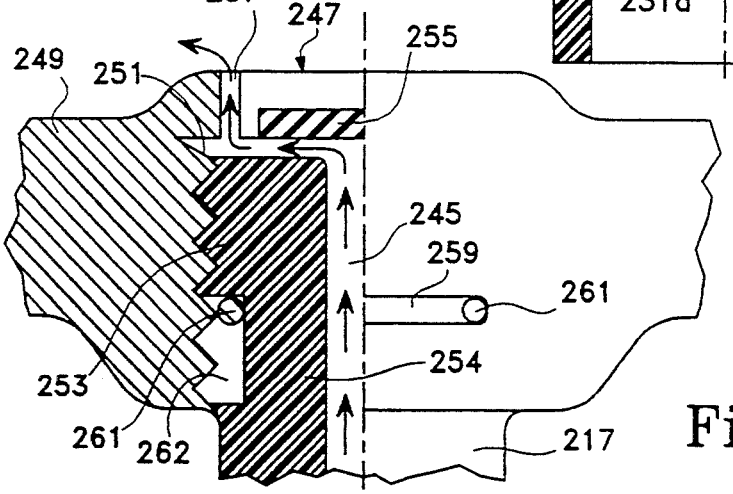
FIG. 26 is an enlarged fragmentary view of a portion of the unit shown in FIG. 24, enlarged in size to illustrate the details of the valve arrangement.

There is a centrally located vertical vent passageway 245 extending upward through the main body 217 from the top of the hollow chamber 223 in the displacer portion. This vent passageway is selectively closed at its upper end by a valve mechanism 247 that is controlled by a handle 249 that also serves to raise and lower the funnel-displacer unit by clockwise or counterclockwise movement, respectively. As best seen in FIG. 26, the handle contains a cavity 251 having an internally threaded wall which mates with external threads 253 formed on the upper end 254 of the central portion of the main body 217. A circular disk gasket 255 is provided in a recess in the wall of the handle at the top of the cavity 251. One or more short vent passageways 257 are provided that extend vertically through the upper wall of the handle spaced outwardly from the gasket 255. A slot 259 cut in the sidewall of the handle 249, that extends completely therethrough, allows the insertion of a hairpin-type retainer 261. The retainer resides in a recess 262 cut in the threaded upper portion 254 of the main body 217, having a pair of complementary bights which frictionally engage the reduced diameter portion of the upper portion 254 about which rotation is permitted. The location of the retainer 261 allows a short counterclockwise upward motion of the handle 249 relative to the main body portion before the hairpin retainer 261 reaches the top of the recess 262 and tightly abuts thereagainst so as to cause the two to thereafter rotate in unison. However, the short relative rotation causes relative upward vertical movement that is sufficient to lift the disk gasket 255 from the upper end of the central vent passageway 245 thus completing the path through the vent passageway 245 to atmosphere via the short vents 257, as shown in FIG. 26.

Figure 25:
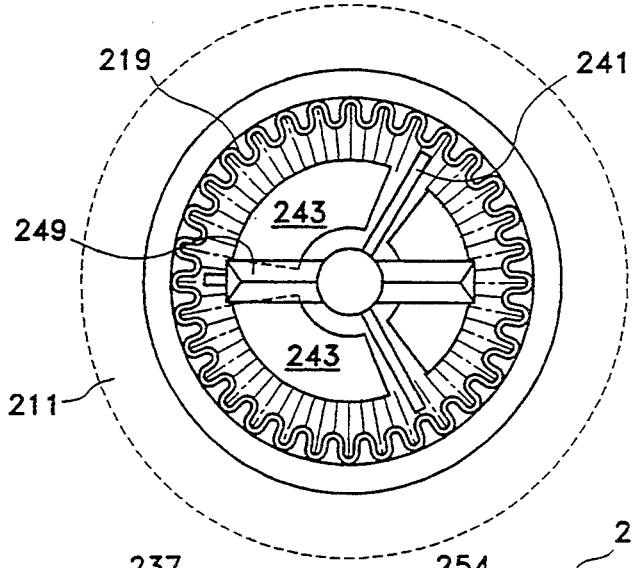
FIG. 25 is a top view of the filling unit shown in FIG. 24.
Figure 24:
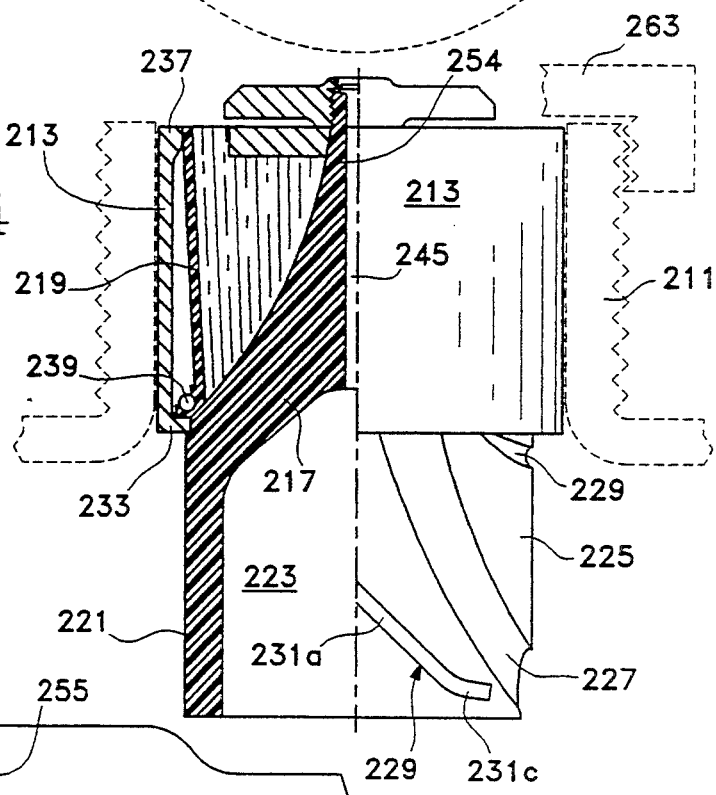
FIG. 24 is a view partially in elevation and partially in section of the filling unit of FIG. 19 shown in the storage orientation, with a fragment of a cap being shown as installed in phantom outline.

As best seen in FIGS. 19 and 24, the foldable plastic funnel 219 is integrally connected and preferably molded as one piece with the short tubular funnel support 235. The molded thermoplastic construction is provided with a memory which causes the funnel 219 to assume its generally frustoconical configuration as seen in FIG. 19 when it is unrestrained. However, when the foldable funnel 219 is being moved to the lowered or storage position, it is dragged downward against the interior face of the annular boss 237 at the upper end of the holder unit 213, causing the flexible thermoplastic material to uniformly fold in a generally ruffled appearance, as best seen in FIG. 25, in which condition it is accommodated in the annular region between the interior surface of the holder unit 213 and the main body 217 of unit 215, as best seen in FIG. 24. In this position, a threaded cap 263 similar to the cap 117 earlier described, is installed to substantially close the threaded tubular inlet 211 so as to allow the gasoline engine or the like to safely operate on fuel from the tank.

When it is time to refuel the tank, the threaded cap 263 is removed, and the user grasps the handle 249 and begins to rotate it clockwise. Rotation of the handle in a clockwise direction causes the handle 249 to initially rotate relative to the main body on the threaded upper end 254 and move vertically downward until the disk gasket 255 seats thereatop. This movement seals the upper end of the central vent passageway 245, and thereafter further rotation of the handle causes the main body 217 to rotate in unison with the handle. The 3 lugs 233 reside in the upper sections 231*b* of the guide slots 229 when the filler unit 205 is in the storage position, and small upwardly extending protrusions 264 may be molded in the bottom wall of the slot portions 231*b* to serve as retainers, as well as in the slot portions 231*c*. However, rotation of the main body relative to the holder unit 213 quickly brings the diagonal guide slot portions 231*a* into engagement with the lugs 233, and thereafter continued rotation in a clockwise direction exerts an upward camming force against the slot walls which causes the funnel-displacer unit to rise upward from the tubular inlet 211 to which the holder unit 213 is cemented. As the upper portion of the foldable funnel 219 clears the annular boss 237, it very slowly begins to unfold, and when it finally totally clears the boss, it has assumed the frustoconical orientation shown in FIG. 19. Rotation of the handle continues until the lugs 233 reach the lower short horizontal sections 231*c* of the guide slot at which time the main body portion 217 has been raised to such an extent that the O-ring 239 is slightly compressed in fluidtight sealing condition against the annular boss 237. If desired, protrusions or retainers can be molded into the upper walls of the horizontal sections 231*c* of the guide slots to "lock" the lugs in this position. As can be seen from FIGS. 19 and 20, the foldable funnel has a series of reference marks 265 that provide a circular maximum-fill line about the funnel.

With the filling unit 205 in the raised filling orientation shown in FIG. 19, the tank is ready to be filled, and fuel, such as gasoline, is poured into the funnel from a storage container, such as is shown in ghost outline in FIG. 19, which is usually equipped with an elongated flexible spout. The funnel-displacer unit, as a result of the 3 radially extending ribs 241, provides 3 separate liquid pathways downward into the tank respectively through the segmental openings 243 and then the connecting curving flow passageways in the exterior, otherwise cylindrical, wall of the displacer portion. Because there are generously sized, multiple pathways into the tank, one of these pathways will always be partially unoccupied by liquid and will serve as a vent for the air initially in the tank. Because the central vent passageway 245 is closed at its upper end by the disk gasket 255, this entire chamber serves as an airlock, and the compressed air within the hollow chamber keeps above about 90% of the volume of the chamber totally free of liquid when the rest of the tank is full and the liquid head extends upward into the funnel portion. The size of the hollow chamber 223 is proportioned so that, if the filling unit 205 is filled with liquid up to the circular line of reference marks 265 on the funnel, all of this liquid can be accommodated within the tank so none will be spilled.

After filling to the reference line 265 has been completed, the user grasps the handle 249 and turns it counterclockwise. The initial movement is of the handle 249 only, which unscrews slightly upward on the threaded central shaft portion 254 of the main body to the orientation shown in FIG. 26 where the gasket 255 is spaced above the top surface of the threaded shaft portion, opening the vent passageway 245 by providing communication with the atmosphere through the short vent passageways 257. This breaks the airlock at the top of the hollow chamber 223 and allows the head of liquid in the funnel to quickly force the air out of the hollow chamber 223 upward through the vent passageways; as a result, all of the liquid in the funnel up to the circular reference marks 265 flows downward into the tank, with some volume left over to accommodate the funnel-displacer unit when it is next moved downward to the storage position. Continued turning of the handle 249 caused the hairpin retainer 261 to abut against the upper wall of the recess 262 so that further counterclockwise movement of the handle results in corresponding counterclockwise movement of the funnel-displacer unit 215. Such counterclockwise movement of the cylindrical outer surface of the displacer portion 221 and the guide slots 229 relative to the 3 lugs 233 which protrude inward from the holder unit 213 causes the 3 lugs to quickly reach the end of the short bottom guide slot sections 231*c* and enter the main diagonal slot portions 231*a*. Thereafter, the camming action resulting from the engagement of the diagonal bottom edges of the guide slots against the stationary lugs causes the funnel-displacer unit to move vertically downward into the interior region of the tubular inlet 211 and the underlying tank. When such relative counterclockwise rotation has proceeded to the point where the lugs reach the upper horizontal sections 231*b*, the funnel-displacer unit is in its fully stowed or storage position depicted in FIG. 24, with the folded funnel 219 disposed within the tank inlet 211 where the exterior cap can be threaded onto the inlet to close the tank. Thus it can be seen that by appropriately sizing the hollow chamber 223, all of the liquid that was residing in the filing unit up to the reference marks 265 of the funnel is able to be accommodated within the tank, regardless of the shape or volume of the underlying tank.

Figure 28:
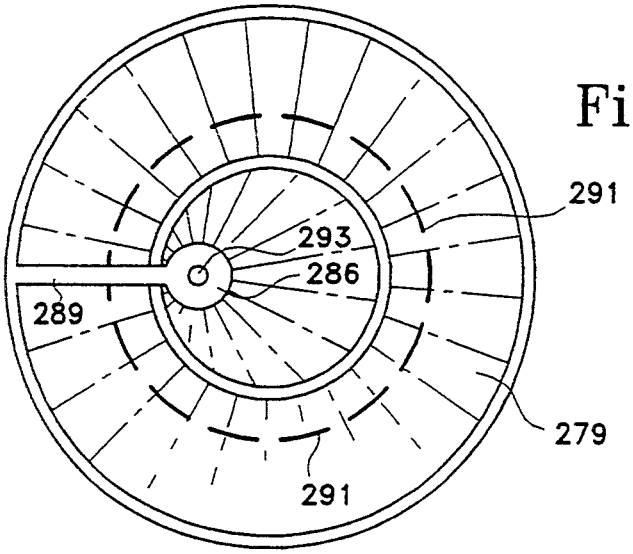
FIG. 28 is a top view of the filling unit of FIG. 27.
Figure 29:
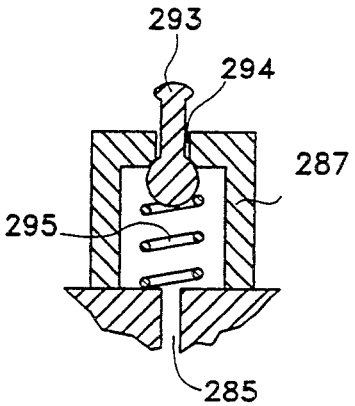
FIG. 29 is a fragmentary sectional view, enlarged in size, showing a valve portion of the unit of FIG. 27.
Figure 27:
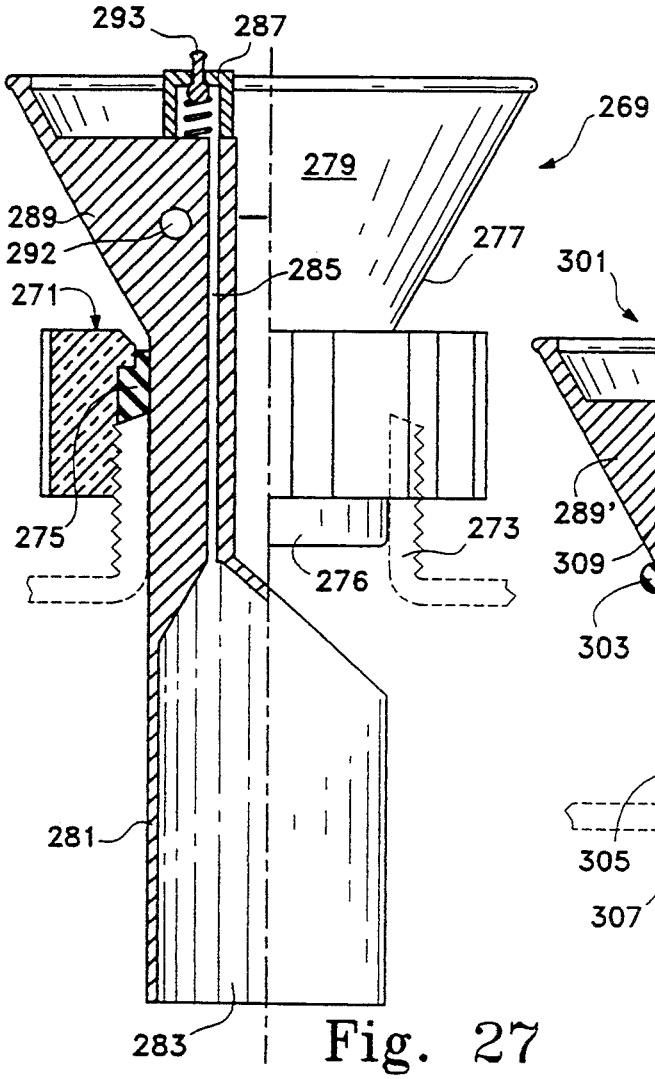
FIG. 27 is an elevational view partly in section of a further embodiment of a filling unit incorporating various features of the invention, which is shown in the filling orientation.

Illustrated in FIGS. 27, 28 and 29 is another alternative embodiment of a filling unit 269 which incorporates some of the features of the filling unit 205 but which is designed to be attached to the tank at the time of filling and removed thereafter, in the general manner of the filling unit 10 described hereinbefore. The unit 269 includes a connector or holder 271 that fits about the tubular inlet 273 to a tank and includes an internal gasket or O-ring 275 for sealing to the upper edge of the tubular inlet, and the holder construction can be generally as described hereinbefore with respect to the connector 11. As best seen in FIG. 27, the gasket 275 creates a seal between an upper circular flange on the connector 271 and a cylindrical wall section 276 of an integral funnel-displacer unit 277. The unit includes an upper funnel section 279 and a lower displacer section 281. The displacer section 281 is shaped so as to be circular in outer cross section to fit through the interior opening provided by the tubular inlet 273 of the tank and to provide a hollow chamber 283 that is open at its bottom. A air flow passageway 285 extends upward from the air chamber through a generally cylindrical stalk section 286 of the unit 277 and terminates slightly below the upper edge of the funnel section 279 where a small valve housing 287 is located.

In the illustrated embodiment, a single fin or rib 289 extends from the stalk portion to the frustoconical wall of the funnel; however, it should be understood that a plurality of fins could be used, particularly if desired to have them function as flow dividers. Thus, the main interior portion of the funnel is open and ready to accept liquid, and it remains open, except for the stalk portion 286 and the fin, downward through the cylindrical section 276 which terminates slightly below the lower end of the connector 271, thus opening generally into the cavity of the tank just above the generally frustoconical upper surface of the displacer section 281. The size of this always open pathway is such that surface tension of the liquid does not deter downward flow therethrough.

The interior surface of the funnel section 279 is provided with reference marks 291 which show the maximum extent to which the unit should be filled; if desired, a circular hole 292 through the fin at this level can also be used to provide a fill reference point. The valve housing 287 provides a fluid-tight chamber in which a reciprocating valve element 293 can be moved up and down, sliding in an opening 294 in the upper wall. The valve member 293 is biased to an upward position by a compression spring 295 which forces the valve member 293 against the lower entrance to this opening 294 and thus seals the valve housing 287 creating an airlock in the entire hollow chamber 283 and the vent passageway 285 so that liquid can enter the bottom only to the extent that the air filling the chamber can be compressed. The valve is best seen in this closed position in FIG. 29.

With the filling unit 269 in place as depicted in FIG. 27, liquid is poured into the funnel section 279 and flows freely downward through the open interior of the tubular section 276 of the funnel-displacer unit 277 while air escapes upward through the same large opening. Because the valve is closed with the valve member 293 being spring-biased against the opening in the upper wall of the valve housing 287, air cannot escape from the hollow chamber 283 when the liquid level rises above the bottom edge, so it remains substantially free of liquid except for whatever slight compression of the air occurs as the head of liquid rises still higher above the lower edge of the displacer section 281. It can be easily seen when the liquid level in the funnel 279 reaches the reference marks 291, and pouring of liquid into the filling unit is halted. The user then sets down the supply can and uses a finger to depress the valve member 293 to open the air vent passageway through the valve housing 287, allowing air to vent from the top of the hollow chamber 283. Thus, the air filling the chamber escapes, allowing the hollow chamber 283 to fill with a predetermined volume of liquid which is calculated to accommodate all of the liquid remaining in the funnel section 279 up to the reference marks 291. As soon as the air has escaped and the liquid in the funnel has dropped to below the upper end of the tubular inlet 273, the user releases the valve member 293, unscrews the connector 271 and removes the filling unit 269 from the tank with liquid on its surface draining into the tank. Upon replacement of the closure cap, the underlying engine is ready for operation with a full tank of fuel, with none having been spilled.

Figure 30:
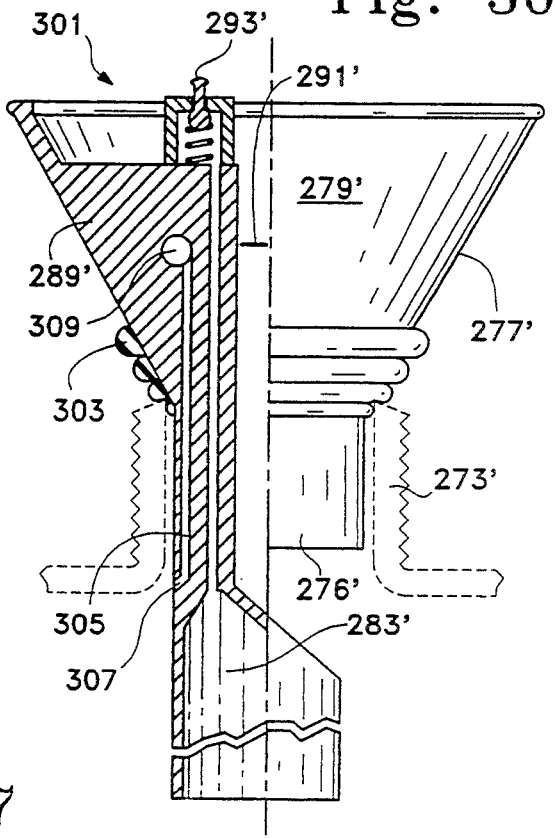
FIG. 30 is a view generally similar to FIG. 27 of an alternative embodiment of a generally similar filling unit embodying various features of the invention.

Depicted in FIG. 30 is a filling unit 301 that is considered to be an alternative embodiment of the filling unit 269 illustrated in FIGS. 27–29; therefore, similar structure is indicated by prime reference numbers. A generally similar funnel-displacer unit 277' is employed which, instead of using a holder similar to the holder 271 which is threaded to the exterior threads on the tubular tank inlet 273', employs a holder 303 in the form of a segmented sealing ring of resilient synthetic rubber material that fits snugly about the exterior of the unit and is preferably adhesively connected near its bottom. As can be seen from FIG. 30, the sealing holder 303 extends from about the top of the cylindrical surface portion 276' a substantial distance up the exterior surface of the funnel section 279'. The holder 303 is molded to have a plurality of segments of regularly vertically increasing diameter so that the sealing-holder will be resiliently accommodated within an inlet opening of a variety of the most standard fuel tanks. Preferably at least one of the segments should fit into the upper region of the tubular inlet and be slightly compressed to form a fluidtight seal at this location. If desired, a sliding expander (not shown) can be provided between the inner surface of the upper portion of the holder 303 and the outer surface of the funnel that can be moved or pressed downward to assure an even tighter seal once the filling unit 301 has been initially mated to the tank inlet 273'. The construction of the funnel-displacer unit 277' is essentially exactly the same as described with respect to the unit 277, with the exception that the thickness of the rib or fin 289' is increased sufficient to accommodate a vertical air vent passageway 305 that leads upward from an entrance 307 in the outer wall of the unit to a hole 309 through the rib at a location about that of the reference marks 291'. As a result, a secondary air vent passageway is provided for the escape of air from the fuel chamber or tank as it is being filled should the down-flowing fuel momentarily fill the entire neck of the funnel. Once the filling unit 301 is filled with fuel up to the reference line 291', the operation is exactly the same as with the filling unit 269. The user simply depresses the valve member 293', allowing the hollow chamber 283' to fill with liquid thereby accommodating all of the liquid in the funnel up to the reference marks. Thereafter, the user simply breaks the seal between the holder 303 and the interior of the tubular inlet 273', removes the filling unit 301 upward from the tank and replaces the cap, and the engine is ready for operation with a full tank of fuel.

Although the invention has been described with respect to several preferred embodiments, it should be understood that one having the ordinary skill in the art could make various combinations of, as well as modifications and changes to, the disclosed embodiments without deviating from the invention which is defined by the claims appended hereto. For example, although threaded interconnections are shown, other suitable types of interconnections, e.g. bayonet connections, can alternatively be used. Although O-rings are generally shown, other types of sealing arrangements can be used that employ normal elastomeric, compressive materials i.e., rubber washers, and frequently the type of sealing material that will be employed will be dependent upon the liquid to be received in the tank in question, with which it must, of course, be compatible. Moreover, one might also replace the O-ring 239 in FIG. 19 with a rolling bladder seal that would be sealed respectively at one end to the lower end of the holder and at its other end to a location on the exterior of the main body where it will remain below the upper end of the holder in the raised position. Although separate vents are not always shown, where installation sizing restrictions cause the central liquid-flow passageway(s) to be small, such separate vents are alternatively utilized, as for example shown in FIG. 30. Although the filling unit is expected to find its primary use in filling tanks with fuel, it can be used with any liquids or flowable solids, even with fluidized particulate materials. The holder sections and filter sections are preferably molded from suitable tough thermoplastic or thermosetting polymeric material, which material should also be resistant to crazing or other degradation by the fluids to be handled. Furthermore, should it be desired to utilize a filling unit like the unit 205 with a Kelch gauge, the vent passageway 245 could be relocated near the outer wall to leave the center completely open; such a structure could include an annular hollow chamber and a short, curved valve handle that lies along the sidewall when the valve is fully open. Preferably, those embodiments of filing units which are removed for storage between uses are constructed of materials and with a design such that liquid drains quickly from the surfaces into the tank during removal of the unit. As previously mentioned, inserts such as metal weights can be molded within portions of the filling units such as those shown in FIGS. 2 and 6 to adjust buoyancy as described. Although preferred vent arrangements are illustrated, other passageway orientations may be used, including extensions that project upward from the funnel unit.

Particular advantages of the invention are emphasized in the claims which follow.

I claim:

1. A filling unit to prevent overfilling of a container having an upstanding generally tubular inlet which container inlet is normally closed by attaching a closure thereto, which filling unit comprises (a) means for engaging said tubular container inlet to seal therewith, (b) funnel means for receiving liquid and leading to an always open depending passageway through which free flow of liquid substantially unhindered by surface tension can occur into said container and through which air in said container can escape upward, said funnel means having a filling position extending above said tubular inlet when said closure is removed, (c) displacer means linked to said engaging means and said funnel means which has a hollow interior region and extends through said tubular inlet when installed and is disposed within said container, said displacer means itself displacing a predetermined amount of liquid in the container when said funnel means is in said filling position, said predetermined amount being such that, when said container is filled with liquid so that liquid extends upward to a predetermined level in said funnel means when in said filling position, said displaced predetermined amount is sufficient so that the entire volume of liquid occupying said funnel means up to said predetermined level when in said filling position can be accommodated in said container, and (d) valve means preventing said hollow interior region of said displacer means from filling when said funnel means is in said filling position and the remainder of the interior of said container is filling with liquid but, upon manipulation without breaking said seal between said engaging means and said container inlet, allowing flow of liquid into said hollow interior region and additional flow of liquid from said funnel means into said container, whereby filling may be carried out so that the liquid level extends above the upper end of said container inlet to a visible location within said funnel means, and whereby manipulation of said preventing means permits all the liquid previously remaining in said funnel means up to said predetermined level in said filling position to be accommodated in said container.

2. A filling unit in accordance with claim 1 wherein said displacer means include a single hollow interior chamber which is capable of holding at least the volume of liquid in said funnel means up to said predetermined level.

3. A filling unit in accordance with claim 2 wherein said displacer means is located immediately adjacent to said container inlet in an upper region of the interior of said container, and wherein opening means is provided so that, as liquid is withdrawn from said container, the liquid previously accommodated in said hollow chamber drains therefrom into the remainder of the interior of said container.

4. A filling unit in accordance with claim 3 wherein flexible drain valve means in said opening means prevents liquid flow therethrough into said hollow chamber when it is empty of liquid.

5. A filling unit in accordance with claim 2 wherein said engaging means includes tubular holder means proportioned to seal to the interior surface of said inlet, wherein said displacer means includes a body proportioned to fit through said holder means except for an upper lip portion which is designed to rest atop said tubular inlet, and wherein said funnel means depends from said lip portion and constitutes a portion of said body, said body being constructed so as to interengage with said holder means and guide vertical movement of said body relative to said holder means and said tank opening, said holder means-body combination providing said hollow interior chamber which is disposed below said funnel means when said body is located in a vertically raised orientation for filling, said holder means and said body being designed so that vertical movement of said body downward relative to said holder means allows liquid in said container to enter said hollow interior chamber.

6. A filling unit in accordance with claim 5 wherein vent passageway means is provided in said body to permit air to escape from within said tank during filling.

7. A filling unit in accordance with claim 5 wherein said displacer means includes a bottom wall that extends radially outward from a tubular structure, which structure depends from the bottom of said funnel means and defines said always open passageway, to an upstanding annular flange which has an upper edge that seals against a lower edge of said tubular holder means when said body is in said vertically raised filling position whereby vertical manipulation of said body permits liquid in said container to overflow said upper edge of said annular flange and enter said hollow interior chamber.

8. A filling unit in accordance with claim 5 wherein said displacer means has a bottom wall that is joined to the lower edge of said tubular holder means and extends inward to boss means having an aperture located on the longitudinal axis of said tubular holder means, and wherein said body includes a hollow stem section which depends from said funnel means and provides said always open passageway below said funnel means, the exterior surface of said stem section being guided for movement within said central aperture means in said boss means.

9. A filling unit in accordance with claim 8 wherein said boss means includes interior thread means and wherein said stem exterior surface includes mating exterior thread means.

10. A filling unit in accordance with claim 9 wherein said isolating means includes opening means in said bottom wall and a peripherally extending element at the bottom end of said stem portion which seals against the undersurface of said bottom wall and blocks liquid flow through said opening means when said body is in said vertically raised filling position.

11. A filling unit in accordance with claim 2 wherein said preventing means includes valve means which when closed prevents air from exiting from the top of said hollow interior chamber.

12. A filling unit in accordance with claim 11 wherein said hollow interior chamber is always open to the interior of said container.

13. A filling unit in accordance with claim 12 wherein said hollow interior chamber has no bottom wall.

14. A filling unit in accordance with claim 11 wherein said funnel means is collapsible radially inward from a liquid-receiving outwardly extended orientation to an orientation in which it is received within said tubular inlet, being biased to said outwardly extended orientation.

15. A filling unit in accordance with claim 14 wherein said engaging means includes holder means for permanent affixation to said tubular inlet, said funnel means being received and being vertically movable within said holder means so that downward vertical movement of said funnel means causes said funnel means to be cammed against said holder means and thereby to radially inwardly collapse.

16. A filling unit in accordance with claim 15 wherein said holder means and said funnel means have interengaging means constructed so that rotary movement of said funnel means relative to said holder means causes relative vertical movement of said funnel means.

17. A filling unit in accordance with claim 16 wherein a separate handle is engaged with said funnel means and wherein said relative rotary movement of said funnel means when in either said filling position or said storage position is effected by turning said separate handle which respectively either opens or closes said valve means before said relative vertical movement of said funnel means begins.

18. A filling unit in accordance with claim 17 wherein said funnel means is made of flexible material and collapses to a pleated configuration.

19. A filling unit in accordance with claim 18 wherein sealing means is provided which creates a fluidtight seal between said holder means and said funnel means when said funnel means is in said filling position.

20. A filling unit to prevent overfilling of a container having an upstanding generally tubular inlet which container inlet is normally closed by attaching a closure thereto, which filling unit is designed for permanent installation in said container and comprises (a) means for permanent engagement with an interior surface of said tubular container inlet and for sealing therewith, (b) funnel means for receiving liquid and leading to an always open depending passageway through which free flow of liquid substantially unhindered by surface tension can occur into said container and through which air in said container can escape upward, said funnel means being vertically movable between a filling position wherein it extends above said tubular inlet with said closure removed and a storage position wherein it is received within said container inlet so said closure can be attached thereto, (c) displacer means linked to said engaging means and said funnel means which provides a hollow interior region, said displacer means extending through said tubular inlet when installed so as to be disposed within said container, said displacer means displacing a predetermined amount of liquid in the container when said funnel means is in said filling position, said predetermined amount being such that, when said container is filled with liquid so that liquid extends upward to a predetermined level in said funnel means when in said filling position, said displaced predetermined amount is sufficient so that the entire volume of liquid occupying said funnel means up to said predetermined level when in said filling position can be accommodated in said hollow interior region, and (d) means preventing said hollow interior region of said displacer means from filling with liquid when said funnel means is in said filling position and the remainder of the interior of said container is filling with liquid but, upon manipulation, allowing flow of liquid into said hollow interior region and thereby additional flow of liquid from said funnel means into container.

21. A filling unit in accordance with claim 20 wherein said preventing means is so constructed that manipulation of said funnel means to move it from the filling position toward the storage position allows said flow of liquid into said hollow interior region of said displacer means.

22. A filling unit to prevent overfilling of a container having an upstanding generally tubular inlet which container inlet is normally closed by attaching a closure thereto, which filling unit comprises (a) means for engaging said tubular container inlet to seal therewith, (b) funnel means for receiving liquid and leading to means defining an always open depending passageway means through which free flow of liquid substantially unhindered by surface tension can occur into said container and through which air in said container can escape upward, said funnel means extending above said tubular inlet when installed in the filling position and air in said container being permitted to escape from the upper portion of the interior of said container to the atmosphere with said funnel means in the filling position, (c) displacer means extending into said container via said tubular inlet when installed and partially defining said passageway means, said displacer means itself displacing an amount of liquid in the container and in said funnel means equal to the volume of said displacer means which lies below a predetermined vertical level in said funnel means, said displaced amount being such that, when said container is filled with liquid so that liquid extends upward to said predetermined vertical level in said funnel means, said displaced amount is sufficient so that the entire volume of liquid occupying said funnel means up to said predetermined vertical level can be accommodated in said container, and (d) said displacer means being manipulatable without disengaging said seal to said tubular container inlet so that said displacer means no longer displaces liquid within said container, whereby filling may be carried out rapidly through said always open passageway so that the liquid level extends above the upper end of said container inlet to a visible location within said funnel means, and whereby manipulation of said displacer means thereafter permits all the liquid previously remaining in said funnel means up to said predetermined vertical level to be accommodated in said container.

23. A filling unit in accordance with claim 22 wherein said displacer means is constructed so as to be slidably received within said always-open passageway means of said funnel means and divides said open passageway into a plurality of vertical passageways which each extend into said container and to a location which is vertically above said predetermined level and open to the atmosphere.

24. A filling unit in accordance with claim 23 wherein said funnel means includes a frustoconical section which lies above a generally cylindrical section and in which said displacer means is slidably received and wherein said displacer means includes an upper portion having at least two surfaces which lie in abutting contact with the interior surface of said frustoconical section of said funnel means to create upper extension regions of said plurality of pathways, whereby manipulation of said displacer means is by upward sliding movement thereof in said cylindrical section of said funnel means.

* * * * *